US005277203A

United States Patent [19]

Hays

[11] Patent Number: 5,277,203

[45] Date of Patent: Jan. 11, 1994

[54] BITE PLATE

[75] Inventor: Marvin B. Hays, Albuquerque, N. Mex.

[73] Assignee: MB Hays, Inc., N. Mex.

[21] Appl. No.: 937,126

[22] Filed: Aug. 31, 1992

[51] Int. Cl.[5] ..... A61C 5/14

[52] U.S. Cl. ..... 128/861; 128/862

[58] Field of Search ..... 128/859, 848, 2, 602.902, 2/2; 602/902

[56] References Cited

U.S. PATENT DOCUMENTS

| | | | |
|---|---|---|---|
| 1,674,336 | 6/1928 | King | 128/861 |
| 2,483,157 | 9/1949 | Singer | 128/861 |
| 2,669,988 | 2/1954 | Carpenter | 128/861 |
| 2,857,909 | 10/1958 | Johnson | 128/861 |
| 3,126,002 | 3/1964 | Owens | 128/861 |
| 4,185,817 | 1/1980 | Peterson | 128/861 |
| 4,955,393 | 9/1990 | Adell | 128/859 |
| 5,092,346 | 3/1992 | Hays | 128/861 |
| 5,174,284 | 12/1992 | Jackson | 128/859 |

*Primary Examiner*—Michael A. Brown

*Attorney, Agent, or Firm*—Cushman, Darby & Cushman

[57] ABSTRACT

A bite plate is provided to protect a user's teeth from damage due to teeth grinding and/or long term interdigitating pressure, as during cervical traction. The device defines a trench for receiving at least some of the upper teeth of a user and is self fitting to accommodate both narrow and wide dental arches. Once inserted into the mouth the device snugly engages the front teeth and remains positioned, keeping the teeth of the upper and lower jaws from directly engaging and being damaged.

15 Claims, 1 Drawing Sheet

BITE PLATE

BACKGROUND OF THE INVENTION

1. Field of the Invention

The present invention relates to a bite plate for protecting the user's teeth from damage due to grinding of the teeth during sleep and/or teeth clinching, for example during cervical traction. In particular, the invention relates to an easy-fit bite plate that can be easily custom fit to accommodate users having a variety of dental arch configurations.

2. Description of the Related Art

Grinding of teeth during sleep results in loss of tooth material which can lead to dental problems such as susceptibility to decay and even tooth loss. Similarly, clinching of the teeth, for example when a patient is in cervical traction, can cause wearing and/or cracking of the teeth as well as headaches and other patient discomfort.

Various devices are known in the art intended for alleviating the problems associated with grinding or high pressure engagement of the teeth. Likewise, other oral devices are known to be received in the mouth to prevent or reduce damage to the teeth during athletic competition, such as boxing or football. Typically bite plates and mouth guards, as they are called, have been customized to the individual user by making a mold of the user's upper teeth/arch and then having a dental laboratory make a custom device. Such a custom molding process is time consuming and relatively expensive—on the order of $300 to $1000 dollars.

SUMMARY OF THE INVENTION

It is an object of this invention to provide a bite plate which can be custom fit to the user and snugly maintained in position to protect the teeth from damage due to grinding and/or forcible interdigitation, without the molding process and dental laboratory facilities which have heretofore been required.

It is a further object to provide a self fitting bite plate which can accommodate a wide variety of dental arches shapes and configurations so that only one or a very few sizes of the device will accommodate all users.

It is yet a further object of the invention to provide a bite plate which is comfortable to use.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
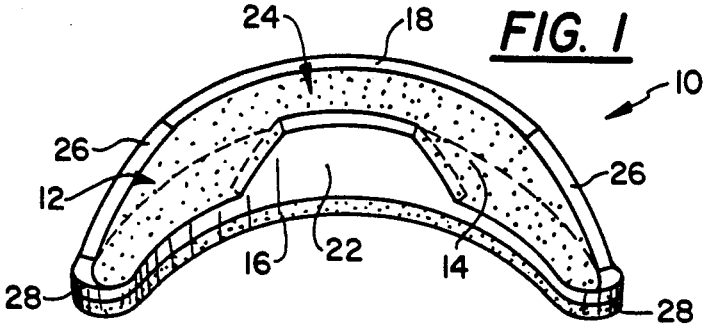
FIG. 1 is a perspective view of a bite plate provided in accordance with the invention.
Figure 2:
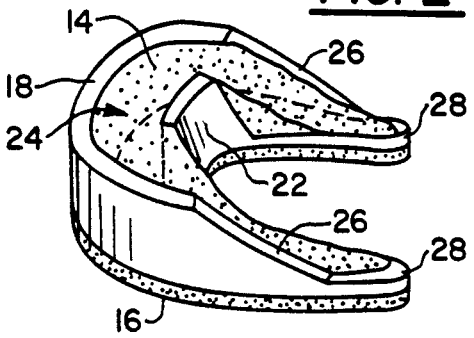
FIG. 2 is a side elevation of the bite plate of FIG. 1.

As illustrated in FIGS. 1–3, the bite plate 10 for user comfort and for protecting the teeth in accordance with the present invention comprises a main body 12 shaped to conform, generally, to an upper dental arch, and adapted to underlie and at least partially engage the users upper teeth, from the front teeth to at least the pre-molar teeth on each side of the user's mouth.

The main body 12 may be formed from a single piece of methylmethacrylate, which is a plastic material used for dentures. If formed of methylmethacrylate, the device must then be cured to prevent absorption of mouth fluids, or cleaning fluids, and to present a smooth non-irritating surface to the soft tissues of the mouth.

However, the main body 12 is most preferably composed of a resilient semi-rigid polycarbonate resin thermoplastic having good physical characteristics and having a specific gravity of about 1.20, a tensile strength (yield) of about 9000 and a softening temperature of about 310 degrees F. An example of such a resin is sold by the General Electric Company under the Registered Trademark LEXAN.

In either event, the relatively rigid material defines the main body 12 of the device 10, and it is preferably used in conjunction with an additional resin material 14, 16 as further discussed below.

In accordance with the invention, a relatively soft resin material is disposed on and bonded to at least certain portions of the main body 12 of the device. That layer is preferably composed of an ethylene-vinyl acetate copolymer resin having a softening and molding temperature of between about 125° and 175° and most preferably about 150°. An example of such a resin is sold by Du Pont Company under the Registered Trademark ELVAX.

As will later be more fully explained, this preferred embodiment is self fitting, for both narrow and wide arches, and one size of the device will accommodate virtually all users. This saves time to fabricate, fit, and adjust the device resulting in significant cost savings over a similar device that must be custom fit, or one that requires the use of molds and the services of a dental laboratory in its construction.

Considering now FIGS. 1 and 2, the bite plate comprises a semicircular structure, more specifically an arch, having an outer boundary area defining a front wall 18, corresponding, generally, to the curvature of an upper dental arch, a bottom wall 20 having a length substantially the same or slightly greater than the front wall 18, and a truncated rearward wall 22 having a length rather significantly less than that of the front wall 18. The front and rear walls 18, 22 define therebetween a front teeth receiving trench 24. In the illustrated embodiment, truncated rearward wall 22 has an upper edge of about 15 mm in arch length and a lower edge portion adjacent the base of the trench of about 25 mm in arch length. The rearward side edges 26 are inclined downwardly from the upper edge to the lower edge portion at an angle of 45 to 60 degrees to intersect with the ends 28 of bottom wall 20.

Figure 3A:
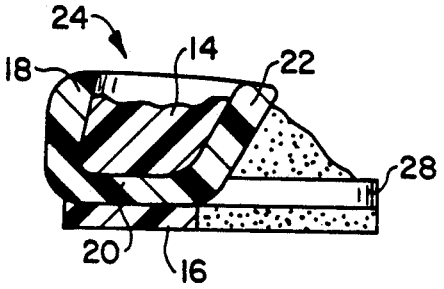
FIG. 3A is a cross-sectional view of the bite plate of FIG. 1.
Figure 3B:
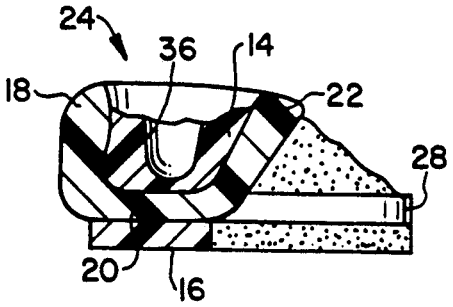
FIG. 3B is a view similar to FIG. 3A showing the tooth impression made when the device is customized to the user.

The resin layers 14, 16 previously described are shown by reference to FIGS. 3A and 3B. A layer of acetate copolymer resin 14 is shown applied to the teeth receiving trench 24 and is adapted to comfortably engage and custom fit the upper teeth of the user. Another layer of acetate copolymer resin 16 is shown applied to the bottom surface of bottom wall 20 for comfortably engaging and, if desired, providing a custom fit for the bottom teeth of the user. The acetate copolymer resin layer is about 3 to 4 millimeters in thickness in the trench and a coating of approximately 2 to 3 millimeters in thickness is applied to the bottom surface of the bottom wall.

FIG. 3B is the same cross-sectional view as in FIG. 3A; the only difference is that FIG. 3B shows a tooth impression 30 in the acetate copolymer resin layer 14 of the trench 24 resulting from the fitting of the device 10 to the patient.

When the device is formed from the polycarbonate resin-thermoplastic having the layers of acetate copolymer resin bonded thereto on the teeth-engaging surfaces, namely the trench 24 which receives the upper teeth and bottom surface of the bottom wall 20 to engage the lower teeth, then individual fitting of the device to the user is greatly simplified, as is user comfort.

More particularly, the acetate copolymer resin has a substantially lower softening and molding temperature than that of the polycarbonate resin-thermoplastic forming the main body of the device. Thus, individual fitting to the user's mouth outside a dental laboratory is possible. Indeed, an immersion of the device 10 in a hot fluid, preferably water, prior to the fitting serves to soften the acetate copolymer resin layerd 14, 16 whereby it accepts the user's distinctive tooth configuration during the fitting process. Upon cooling to ambient temperature, the acetate copolymer resin retains the user's tooth configuration, for ease of repeat placement by the user. Excess resin can be cut from the device to make the device more comfortable to use. Additional minor adjustment may be advisable to increase comfort for the user or to modify the alignment of the device. If extensive dental work is later performed or if mechanical damage occurs, a new fitting may be necessary for mechanical comfort and ease of use.

As is apparent from the foregoing, in order to accommodate users having a variety of dental arch shapes and widths, truncated wall 22 has an arch length somewhat less than that of wall 18. Thus, the rear wall 22 lies behind the front teeth and the front teeth are snugly received between the front and rear walls, preferably in the relatively soft filler material, as described above. As the rear wall terminates laterally with edges which slope downwardly to intersect bottom wall 20, and has a relatively short arc length of about 15 mm at its upper edge and about 25 mm at its lower edge, the device can be fit to a patient substantially irrespective of the disposition and arch of the patient's teeth rearwardly of the front teeth. Thus, as is apparent from the foregoing and as can be seen from FIG. 1, in particular, to achieve the objects of the invention, the angle transcribed by the rear wall is substantially less than the angle transcribed by the front wall. Thus, substantially irrespective of the curvature of the user's dental arch, the device can be fitted and snugly retained in proper position in the mouth.

As a result, with a single or relatively few sizes in inventory, the device can be fitted to the patient by a dentist in a matter of minutes. With proper instructions and safeguards, the device could also be self-fitted by the patient.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. A device for placement in the mouth to protect the teeth from damage, comprising:

a main body having a curved shape which generally corresponds to the shape of an upper dental arch, said main body having a forward wall having a first length, a truncated rearward wall having a second length which is substantially less than said first length such that an angle transcribed by said rearward wall is substantially less than an angle transcribed by said forward wall, and a bottom wall disposed in a substantially horizontal plane from said forward wall rearwardly and having a length substantially equal to or greater than said first length, said rearward wall has a length substantially less than said bottom wall; said forward wall, said truncated rearward wall, and said bottom wall defining therebetween an upwardly open tooth receiving trench for receiving at least a portion of at least some of the upper teeth of the user, said main body being formed from a first material; and a second material disposed in said tooth receiving trench, said second material having a softening and molding temperature substantially less than that of said first material.

2. A device as in claim 1, wherein said first material comprises a resilient semi-rigid thermoplastic material.

3. A device as in claim 2, wherein said resilient semi-rigid material comprises a polycarbonate resin thermoplastic having a specific gravity of about 1.2, tensile strength (yield) of about 9,000 PSI, and a softening temperature of about 310 degrees Fahrenheit.

4. A device as in claim 3, wherein said second material comprises a thermoplastic material having a softening and molding temperature of about between about 125 and 175 degrees Fahrenheit.

5. A device as in claim 2, wherein said second material comprises a thermoplastic material having a softening and molding temperature of between about 125 and 175 degrees Fahrenheit.

6. A device as in claim 5, wherein said second material is a ethylene-vinyl acetate copolymer resin having a softening and molding temperature of about 150 degrees Fahrenheit.

7. A device as in claim 1, further comprising a layer of said second material bonded to a bottom surface of said bottom wall.

8. A device as in claim 7, wherein said layer is about 2–3 millimeters in thickness.

9. A self fitting bite plate consisting essentially of:

a main body having a curved shape which generally corresponds to the shape of an upper dental arch, said main body having a forward wall having a first length, a truncated rearward wall having a second length which is substantially less than said first length such that an angle transcribed by said rearward wall is substantially less than an angle transcribed by said forward wall, and a bottom wall disposed in a substantially horizontal plane from said forward wall rearwardly and having a length substantially equal to or greater than said first length, said rearward wall has a length substantially less than said bottom wall; said forward wall, said truncated rearward wall, and said bottom wall defining therebetween an upwardly open tooth receiving trench for receiving at least a portion of at least some of the upper teeth of the user, said main body being formed from a first material;

a second material disposed in said tooth receiving trench, said second material having a softening and molding temperature substantially less than that of said first material; and a layer of said second material bonded to a bottom surface of said bottom wall.

10. A device as in claim 9, wherein said first material comprises a resilient semi-rigid thermoplastic material.

11. A device as in claim 10, wherein said resilient semi-rigid material comprises a polycarbonate resin thermoplastic having a specific gravity of about 1.2, tensile strength (yield) of about 9,000 PSI, and a softening temperature of about 310 degrees Fahrenheit.

12. A device as in claim 11, wherein said second material comprises a thermoplastic material having a softening and molding temperature of about between about 125 and 175 degrees Fahrenheit.

13. A device as in claim 10, wherein said second material comprises a thermoplastic material having a softening and molding temperature of between about 125 and 175 degrees Fahrenheit.

14. A device as in claim 13, wherein said second material is a ethylene-vinyl acetate copolymer resin having a softening and molding temperature of about 150 degrees Fahrenheit.

15. A device as in claim 9, wherein said layer is about 2–3 millimeters in thickness.

* * * * *